United States Patent [19]

Fujita

[11] Patent Number: 4,840,149

[45] Date of Patent: Jun. 20, 1989

[54] CAMSHAFT APPARATUS FOR AN INTERNAL COMBUSTION ENGINE

[75] Inventor: Hiroya Fujita, Anjo, Japan

[73] Assignee: Toyota Jidosha Kabushiki Kaisha, Aichi, Japan

[21] Appl. No.: 214,730

[22] Filed: Jul. 1, 1988

[30] Foreign Application Priority Data

Jul. 7, 1987 [JP] Japan ..... 62-103297[U]

[51] Int. Cl.[4] ..... F01L 1/04; F01M 1/06

[52] U.S. Cl. ..... 123/90.31; 123/90.34

[58] Field of Search ..... 123/90.18, 90.27, 90.31, 123/90.33, 90.34, 196 R, 55 VE, 55 VF, 55 VS, 90.22; 184/6.5

[56] References Cited

U.S. PATENT DOCUMENTS

| | | | |
|---|---|---|---|
| 4,199,202 | 4/1980 | Maeda | 123/196 R |
| 4,258,673 | 3/1981 | Stoody, Jr. et al. | 123/90.34 |
| 4,610,224 | 9/1986 | Fujita | 123/90.31 |

FOREIGN PATENT DOCUMENTS

| | | |
|---|---|---|
| 61-145306 | 7/1986 | Japan . |
| 61-232305 | 10/1986 | Japan . |
| 62-110 | 1/1987 | Japan . |
| 62-8424 | 1/1987 | Japan . |
| 62-8425 | 1/1987 | Japan . |

*Primary Examiner*—Charles J. Myhre
*Assistant Examiner*—Weilun Lo
*Attorney, Agent, or Firm*—Kenyon & Kenyon

[57] ABSTRACT

A camshaft apparatus in which different amounts of oil are supplied to both sides of a thrust bearing for a camshaft driven by another camshaft through helical gears. A bearing cap, which is a part of the thrust bearing for the camshaft, is formed with first and second holes communicating with both sides of the thrust bearing. The first hole is located at a certain angular position from the center of the camshaft, and the second hole is located at another certain angular position from the center of the camshaft.

5 Claims, 3 Drawing Sheets

CAMSHAFT APPARATUS FOR AN INTERNAL COMBUSTION ENGINE

BACKGROUND OF THE INVENTION

1. Field of the Invention

The present invention relates to a camshaft apparatus, more particularly, to a construction of a thrust bearing supporting a camshaft provided for a V-type double overhead camshaft engine.

2. Description of the Related Art

In a conventional V-type double overhead camshaft engine (referred to as DOHC engine hereinafter), right and left cylinder block-cylinder head assemblies are provided with a camshaft for intake valves and a camshaft for exhaust valves, respectively; i.e., the engine is provided with four camshafts. Accordingly, the number of camshafts is twice that of a usual straight type engine, so that the number of parts of a DOHC engine is larger than a straight type engine.

Japanese Unexamined Patent Publication No. 61-145306 discloses a construction by which common parts are used for camshafts disposed on right and left banks, respectively, to improve a productivity of the engine by reducing the number of parts thereof, and Japanese Unexamined Patent Publication No. 61-232305 shows a construction in which a layout of a driving mechanism for camshafts of V-type DOHC engine is improved so that right and left cylinder heads having the same shape are mounted, and thus the engine becomes more compact.

In camshafts of a V-type engine in which a plurality of intake valves and exhaust valves are synchronously open and closed by two camshafts, and a rotation of one of the camshafts is transmitted to the other camshaft through helical gears, a problem arises of an absorption of a thrust force generated in the other camshaft. Japanese Unexamined Utility Model Publication Nos. 62-110, 62-8424, and 62-8425 disclose a construction of a thrust bearing for a camshaft for resolving this problem. In these publications, a camshaft is formed with an annular thrust flange to define a small clearance between at least one side face of the annular flange and a bearing member, and a hole or groove for supplying lubricating oil to the one side face of the annular flange is formed in the flange or the bearing member. FIG. 1 shows such a construction as disclosed in Japanese Unexamined Utility Model Publication No. 62-8424. In the drawing, a camshaft 50 is rotatably supported in a hole defined by a supporting portion 70 formed on a cylinder head and a bearing cap 60, and flanges 51 and 52 are formed on both sides of the bearing cap 60, so that a thrust bearing portion 80 is defined by the bearing cap 60, the supporting portion 70, and the flanges 51 and 52. Sliding surfaces 81 and 82 on the flanges 52 and 51 face or are in contact with side faces of the bearing cap 60 and the supporting portion 70, and lubricating oil is supplied to one sliding face 81 through oil passages 53 and 71. This publication also describes another construction, in which an oil passage is open to both flanges to supply lubricating oil to both sliding surfaces 81 and 82. In the above constructions, an oil film is always formed on the sliding surfaces, so that abrasion of a bearing surface and noise generated by interference between the camshaft and the bearing surface are prevented.

In a conventional V-type DOHC engine, as understood from FIG. 2, two cylinder heads 11, 21 having the same shape are disposed in parallel to each other in such a manner that a front portion of one of the cylinder heads is disposed next to a rear portion of the other of the cylinder heads, and camshafts are disposed in parallel to each other in such a manner that the front portions of the camshafts of one of the cylinder heads are next to the rear portions of the camshafts of the other cylinder head.

Note, in this description, to simplify the explanation of the layout of the components, the terms "front portion" and "rear portion" are used with respect to the front and rear ends of the vehicle in which the engine is mounted, as denoted by the arrows F and R in FIG. 2.

As shown in FIG. 2, first camshafts 12 and 22 mounted on the cylinder heads 11 and 21 are rotated in the same direction through a belt or a sprocket by the crankshaft of the engine, and second camshafts 13 and 23 are rotated through helical gears 14 and 24 by the rotation of the first camshafts 12 and 22. The gears and members in the bearing portions for the camshafts are employed commonly with respect to the two cylinder heads 11 and 21, as much as possible. The front portions of the camshafts 12 and 13 of the cylinder head 11 are arranged next to the rear portions of the camshafts 22 and 23 of cylinder heads 21, so that a thrust force acts on thrust bearing portions 30 and 31 in the same direction with regard to the second camshafts 13 and 23.

If a groove or hole for supplying lubricating oil to one side of the sliding surfaces as shown in FIG. 1 is provided in the camshafts constructed as described above, in one of the cylinder heads, an oil pressure acts on a side face of the flange (e.g., 51) subjected to a relatively large thrust, and in the other of the cylinder heads, an oil pressure acts on a side face of the flange (e.g., 52) subjected to a relatively low thrust, so that a noise generated by interference between the camshafts and the thrust bearings is not reduced in the other of the cylinder heads. Conversely, if the thrust bearings are constructed in such a manner that the camshafts of the two cylinder heads are subjected to thrust forces acting in the same direction, the thrust bearings in each cylinder have must have a different construction; namely, these thrust bearings can not be commonly used by the two cylinder heads, and thus the cost of assembly is increased.

On the other hand, in a construction in which lubricating oil is supplied to both side faces of the sliding surface of the flange formed on the camshaft, since the camshaft is pressed in both directions by lubricating oil supplied to both side faces, and thus the camshaft is not subjected to a large thrust force, noise generated by interference between the thrust bearings and the camshafts is not satisfactory reduced.

SUMMARY OF THE INVENTION

An object of the present invention is to hold the camshafts of an engine in a predetermined axial position when the engine is driven, so that abrasion of the bearings of the camshafts and noise generated by interference between the bearing and the camshafts are prevented. Another object of the present invention is to construct a camshaft apparatus commonly employing the same bearing members in the two cylinder heads, so that the assembly productivity is improved.

According to the present invention, there is provided a camshaft apparatus provided for an internal combustion engine having two cylinder heads disposed in parallel to each other in such a manner that a front portion of one of the cylinder heads is disposed near a rear portion of the other of the cylinder heads. The two cylinder heads are provided with at least one support portion projecting therefrom and at least one bearing cap fixed on the support portion to define a cylindrical supporting hole therebetween. The camshaft apparatus comprises first camshafts disposed on each of the two cylinder heads, respectively, second camshafts disposed on each of the two cylinder heads, respectively, helical gears mounted on the first and second camshafts, respectively, and a lubricating oil supply means. Each of the first camshafts being driven by the engine to rotate in the same direction.

Each of the second camshafts is rotatably supported by the cylindrical supporting hole, and formed with at least two large diameter portions having a diameter larger than the supporting hole. One of the at least two large diameter portions is located on one side of the bearing cap and the other of the at least two large diameter portions is located on the other side of the bearing cap, to define first and second lubricating gaps between the large diameter portion and the bearing cap. The helical gears mounted on the first and second camshafts engage with each other to transmit a rotation of the first camshaft to the second camshaft. The oil supply means supplies different amounts of oil to the first and second lubricating gaps to urge the camshaft in a predetermined direction.

BRIEF DESCRIPTION OF THE DRAWINGS

The present invention may be more fully understood from the description of preferred embodiments of the invention set forth below, together with the accompanying drawings, in which.

DESCRIPTION OF THE PREFERRED EMBODIMENTS

Figure 1:
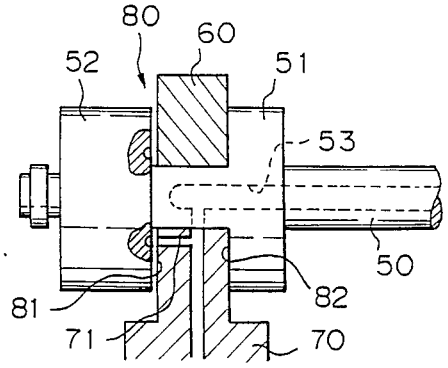
Fig. 1 PRIOR ART
FIG. 1 is a sectional view of a prior art arrangement.

The present invention will now be described with reference to the embodiment thereof shown in the drawings.

Figure 2:
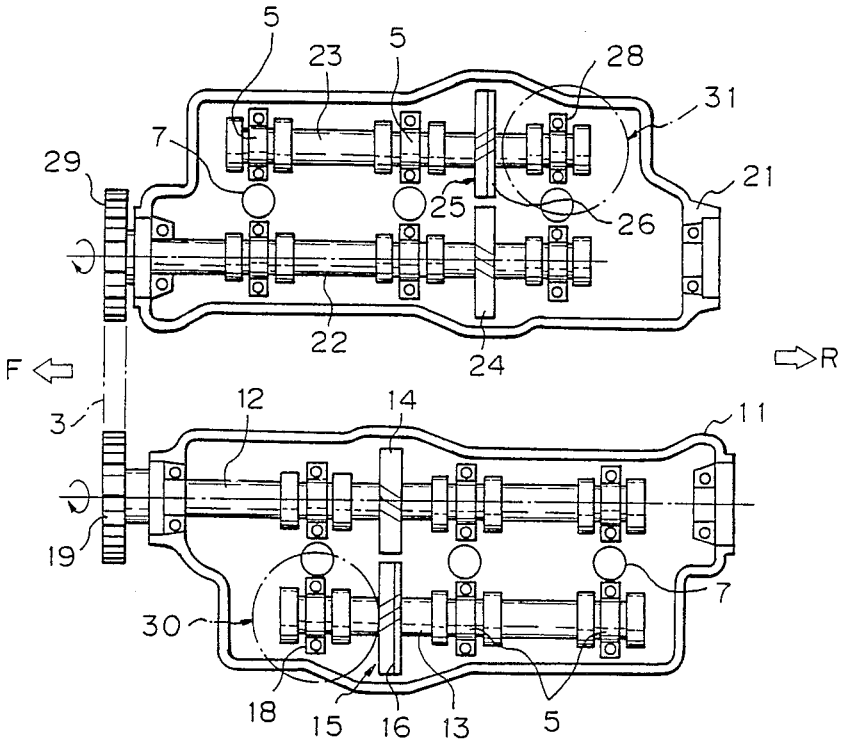
FIG. 2 is a plan view of cylinder heads of a V-type DOHC engine to which an embodiment of the present invention is applied.

FIG. 2 is a plan view of cylinder heads of a V-type DOHC 6 cylinder engine including a camshaft apparatus as an embodiment of the present invention. Two cylinder heads 11 and 21 are disposed in parallel to each other in such a manner that a front portion of the cylinder head 11 is disposed near a rear portion of the cylinder head 21. These cylinder heads 11 and 21 have the same shape. First camshafts 12 and 22 are disposed on each of the cylinder heads 11 and 21, respectively, and each of the first camshafts 12 and 22 is driven by cam pulleys (or sprockets) 19 and 29 which are driven through a crankshaft (not shown) of the engine and a belt 3 to rotate in the same direction; i.e., rotate clockwise, as shown by arrows in the drawing, when viewed from the front of the vehicle. Second camshafts 13 and 23 are also disposed on each of the cylinder heads 11 and 21, respectively.

Helical gears 14 and 24 having gear teeth inclined in a predetermined direction with respect to the axis of the gear are mounted on the first camshafts 12 and 22, respectively, and helical gears 15 and 25 having gear teeth inclined in an opposite direction to the inclination of the teeth of the helical gears 14 and 24 are mounted on the second camshafts 13 and 23, respectively. The helical gears 14 and 24 mate with the helical gears 15 and 25, respectively, to transmit a rotation of the first camshafts 12 ad 22 to the second camshafts 13 and 23, which rotate in the counterclockwise direction when viewed from the front of the vehicle, so that the second camshafts 13 and 23 are subjected to a thrust forcing them in the front direction shown by the arrow F in the drawing. As is clear from the above description, the helical gears 14 and 24 are drive gears, and the helical gears 15 and 25 are driven gears. The driven gears 15 and 25 include subgears 16 and 26 to construct scissors gears, respectively, which eliminate play between the driven gears 15 and 25 the drive gears 14 and 24, as is well known, to reduce noise generated by such play during rotation of the camshafts.

If the first camshafts 12 and 22 are used to open and close intake valves, the second camshafts 13 and 23 are used to open and close exhaust valves, and vice versa. Bearing caps 18 and 28 are provided at thrust bearing portions 30 and 31 for the second camshafts 13 and 23, respectively, and bearing caps 5 are provided at journal bearing portions of the second camshafts 13 and 23. Reference numeral 7 denotes spark plug apertures.

Figure 3:
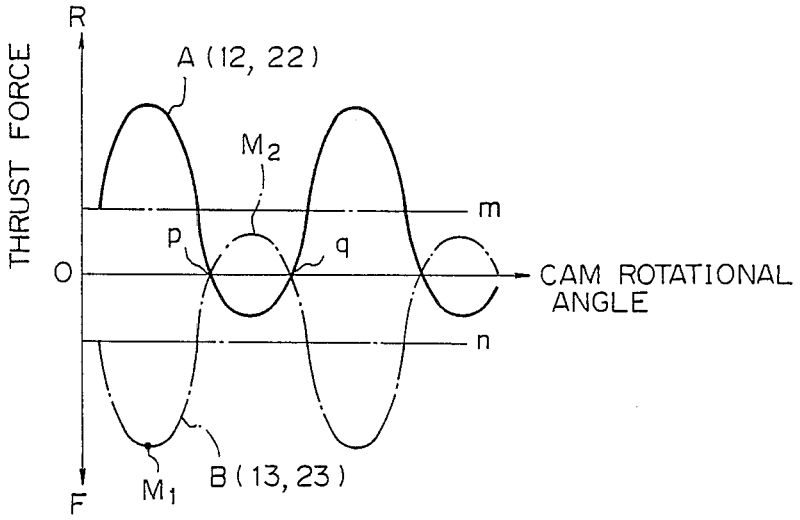
FIG. 3 is a graph showing a thrust force acting on the camshafts.

FIG. 3 shows a change of the thrust force acting on each camshaft constructed as described above, during rotation thereof. A solid line A shows a change of thrust force of the first camshafts 12 and 22, and a chain line B shows a change of thrust force of the second camshafts 13 and 23, upon each one rotation of the camshafts. The thrust forces of the first camshafts 12 and 22 change about the line "m" located above the axis of abscissa, due to a thrust force towards the rear, as shown by the arrow R in FIG. 2, generated by rotational friction. The thrust forces of the second camshafts 13 and 23 change about the line "n" located under the axis of abscissa, due to a thrust force towards the front, as shown by the arrow F in FIG. 2, and also generated by rotational friction. As understood from the graph, the direction of the thrust force changes from toward the rear to toward the front, with the points "p" and "q" denoting the boundary between the two directions, and the thrust forces acting on the first camshafts 12 and 22 are always in the opposite direction to the thrust forces acting on the second camshafts 13 and 23.

Thus, for the second camshafts 13 and 23, the maximum value "$M_1$" of the thrust force acting toward the front direction F is larger than the maximum value "$M_2$" of the thrust force acting toward the rear direction R, as shown in FIG. 3. That is, during rotation, the second camshafts 13 and 23 are subjected to a relatively large thrust force in the front direction F, and to a relatively small thrust force in the rear direction R, so that members of the thrust bearing portions 30 and 31 interfere with each other to generate noise.

Figure 6:
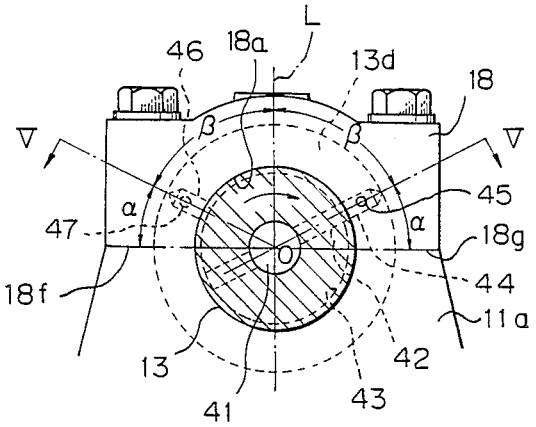
FIG. 6 is a sectional view of the thrust bearing portion taken along the line VI—VI of FIG. 4.
Figure 4:
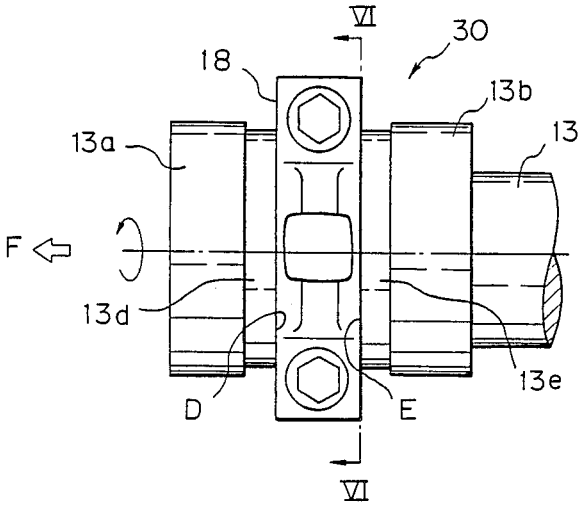
FIG. 4 is a plan view of a thrust bearing portion of a camshaft of the embodiment of the present invention.
Figure 5:
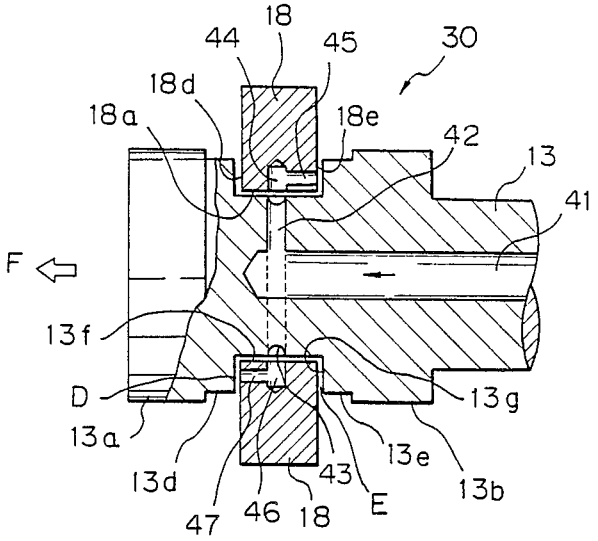
FIG. 5 is a sectional view of the thrust bearing portion taken along the line V-O-V of FIG. 6.

In this embodiment of the present invention, the thrust bearing portions 30 and 31 are constructed in such a manner that this noise is prevented. FIGS. 4, 5, and 6 show a construction of the thrust bearing portion 30 of the second camshaft 13 in detail. Note, the construction of the thrust bearing portion 31 is identical to that of the thrust bearing portion 30, and therefore, the following description applies equally to the bearing portion 31.

In FIGS. 4, 5, and 6, the cylinder head is provided with at least one support portion 11*a* projecting from top surface of the cylinder head, and a bearing cap 18 fixed on the support portion 11*a* to thereby define a cylindrical supporting hole 18*a* between the bearing cap 18 and the supporting portion 11*a*. The second camshaft 13 is rotatably supported in the cylindrical supporting hole 18*a*, and formed with two large diameter portions 13*d* and 13*e* having diameters larger than the supporting hole 18*a*. The large diameter portions 13*d* and 13*e* are formed on side faces of the cams 13*a* and 13*b*, respectively, adjacent to the bearing cap 18. Namely, one of the at least two large diameter portions 13*d* and 13*e* is located on one side of the bearing cap 18, and the other of the two large diameter portions 13*d* and 13*e* is located on the other side of the bearing cap 18, to define a first lubricating gap D between a side face 13*f* of a large diameter portion 13*d* and a side face 18*d* of the bearing cap 18, and a second lubricating gap E between a side face 13*g* of the large diameter portion 13*e* and a side face 18*e* of the bearing cap 18.

Lubricating oil is supplied into the first and second lubricating gaps D and E, through holes formed in the second camshaft 13 and the bearing cap 18. Namely, a first oil passage 41 is formed in the camshaft 13 along the axis thereof to connect an oil source (not shown) to an end portion between the two large diameter portions 13*d* and 13*e*, and a second oil passage 42 is formed in the camshaft 13 to extend in a radial direction and communicate with the end portion of the first oil passage 41. An annular groove 43 is formed on an outer surface of the camshaft 13 rotatably supported in the cylindrical hole 18*a*, and communicates with the second oil passage 42. Namely, the annular groove 43 is always in communication with the first and second holes 41 and 42, and thus is supplied with lubricating oil. A first axial hole 47 is formed in the bearing cap 18 and extended in the axial direction thereof to communicate with the first lubricating gap D, and a second axial hole 45 is formed in the bearing cap 18 and extended in the axial direction thereof to communicate with the second lubricating gap E. Namely, the first and second axial holes 47 and 45 open in opposite directions with respect to the axial line of the camshaft 13. A first radial hole 46 is formed in the bearing cap 18 to connect the first axial hole 47 to the cylindrical supporting hole 18*a*, and a second radial hole 44 is formed in the bearing cap 18 to connect the second axial hole 45 to the cylindrical supporting hole 18*a*. Accordingly, the first and second axial holes 47 and 45 are always in communication with the annular groove 43, and thus are supplied with lubricating oil from the oil source.

The bearing cap 18 has first and second bottom surfaces 18*f* and 18*g* which are located on a horizontal plane passing through the center of the camshaft 13 and located on opposite sides with respect to the axis of the camshaft 13. The first axial hole 47 is located above the first bottom surface 18*f* and is open to the first lubricating gap D, and the second axial hole 45 is located above the second bottom surface 18*g* and is open to the second lubricating gap E. The first axial hole 47 and the second axial hole 45 are located at the same distance from the horizontal planes 18*f* and 18*g*, respectively. As understood from FIG. 6, the first and second axial holes 47 and 45 are located on the same circle, the center of which is located on the axis of the camshaft 13, but are located at different angular positions in the circle. Namely, the first axial hole 47 is located at a point of the circle which is $\alpha°$ away from the first bottom surface 18*f* and $\beta°$ away from the line L vertical to the bottom surface 18*f*, and the second axial hole 45 is located at a point of the circle which is $\alpha°$ away from the second bottom surface 18*g* and $\beta°$ away from the vertical line L.

In FIG. 6, the camshaft 13 rotates in the direction shown by an arrow, and therefore, lubricating oil discharged from the second axial hole 45 is supplied to the second lubricating gap E (FIG. 5), and due to the direction of rotation of the camshaft 13 shown in FIG. 6, the lubricating oil is made to flow into the second lubricating gap E, through an angle $\alpha°$ , and then into a gap between the supporting portion 11*a* and the large diameter portion 13*e*, to be released from the second lubricating gap E. Lubricating oil discharged from the first axial hole 47 is made to flow into the first lubricating gap D (FIG. 6), by the rotation of the camshaft 13, through an angle $(\beta+\beta+\alpha)°$, and then into a gap between the supporting portion 11*a* and the large diameter portion 13*d*, to be released from the first lubricating gap D. Namely, lubricating oil is supplied to the second lubricating gap E in an amount corresponding to the length of the angle $\alpha°$, and lubricating oil is supplied to the first lubricating gap D in an amount corresponding to the length of the angle $(\beta+\beta+\alpha)°$, and thus the first and second lubricating gaps D and E are supplied with different amounts of lubricating oil.

Accordingly, the period for which a lubricating oil pressure acts on the first lubricating gap D is longer than a period for which a lubricating oil pressure acts on the second lubricating gap E, since the first and second lubricating gaps D and E are supplied with different amounts of oil. Therefore, a pressure Dp acting on the side face 13*f* is always higher than a pressure Ep acting on the side face 13*g*, and thus the camshaft 13 is urged in the front direction F (FIG. 5) by the pressure difference between the gaps D and E. As shown in FIG. 3, in a thrust force B (chain line) acting on the camshaft 13, the thrust force toward the front direction F is larger than the thrust force toward the rear direction R. Due to the pressure difference described above, since the camshaft 13 is pressed by the thrust force (Dp-Ep), the maximum value $M_2$ of the thrust force toward the rear direction R is reduced so that it does not rise above the line O, so that the camshaft 13 is always subjected to a thrust force in only the front direction F when the engine is driven. Therefore, the camshaft 13 is prevented from reciprocating between the front and rear directions, so that noise generated by interference between a part of the camshaft 13 and the bearing cap 18 is prevented, and as a result, noise and abrasion due to a change of direction of the thrust force of the camshaft 13 is substantially eliminated.

Although the embodiments of the present invention have been described herein with reference to the attached drawings, many modifications and changes may be made by those skilled in this art without departing from the scope of the invention.

I claim:

1. A camshaft apparatus provided for an internal combustion engine having two cylinder heads disposed in parallel to each other in such a manner that a front portion of one of said cylinder heads is disposed near a rear portion of one of the other of said cylinder heads, said two cylinder heads being provided with at least one support portion projecting therefrom and at least one bearing cap fixed on said support portion to define a cylindrical supporting hole therebetween, said camshaft apparatus comprising:

first camshafts disposed on each of said two cylinder heads, respectively, each of said first camshafts being driven by said engine to rotate in the same direction;

second camshafts disposed on each of said two cylinder heads, respectively, each of said second camshafts being rotatably supported by said cylindrical supporting hole, and formed with at least two large diameter portions having diameters larger than said supporting hole, one of said at least two large diameter portions being located on one side of said bearing cap and the other of said at least two large diameter portions being located on the other side of said bearing cap to define first and second lubricating gaps between said large diameter portions and said bearing cap;

helical gears mounted on said first and second camshafts, respectively, said helical gears mating with each other to transmit a rotation of said first camshafts to said second camshafts; and means for supplying lubricating oil to said first and second lubricating gaps, said oil supply means supplying different amounts of oil to said first and second lubricating gaps, respectively, to produce a pressure differential between said first and second lubricating gaps and thereby urge said camshaft in a predetermined direction.

2. A camshaft apparatus according to claim 1, wherein said oil supply means includes a first hole formed in said bearing cap to communicate with said first lubricating gap, a second hole formed in said bearing cap to communicate with said second lubricating gap, said first and second holes opening in opposite directions with respect to the axial line of said camshaft, and a second oil supply means for supplying lubricating oil to said first and second holes.

3. A camshaft apparatus according to claim 2, wherein said second oil supply means includes a first oil passage formed in said camshaft along the axis thereof, an annular groove formed on a surface of said camshaft rotatably supported in said cylindrical supporting hole, and a second oil passage formed in said camshaft along a radial direction thereof, said annular groove being always in communication with said first and second holes.

4. A camshaft apparatus according to claim 2, wherein said bearing cap has first and second bottom surfaces which are located on a horizontal plane passing through the center of said camshaft and located on opposite sides with respect to the axis of said camshaft, said first hole opening at a first portion of said first lubricating gap, said second hole opening at a second portion of said second lubricating gap, said first portion of said first lubricating gap being located above said first bottom surface, and said second portion of said second lubricating gap being located above said second bottom surface.

5. A camshaft apparatus according to claim 4, wherein said first hole and said second hole are located at the same distance from said horizontal plane passing through the center of said camshaft.

* * * * *

UNITED STATES PATENT AND TRADEMARK OFFICE

CERTIFICATE OF CORRECTION

PATENT NO. : 4,840,149

DATED : June 20, 1989

INVENTOR(S) : Hiroya FUJITA

It is certified that error appears in the above-identified patent and that said Letters Patent is hereby corrected as shown below:

| Column | Line | Corrections |
|---|---|---|
| 4 | 12 | change "ad" to --and--. |
| 4 | 22 | after "25" insert --and--. |
| 6 | 31 | after "D and" insert --E--. |
| 7 | 1 | after "portion of" delete "one of". |

Signed and Sealed this

Twenty-fourth Day of April, 1990

*Attest:*

HARRY F. MANBECK, JR.

*Attesting Officer*

*Commissioner of Patents and Trademarks*